US009079410B2

(12) United States Patent
Garcia et al.

(10) Patent No.: US 9,079,410 B2
(45) Date of Patent: Jul. 14, 2015

(54) METHODS AND CASSETTES FOR DISCARDING INK

(75) Inventors: Luis Garcia Garcia, Barcelona (ES); Sergio Puigardeu Aramendia, Barcelona (ES); Angel Martinez Barambio, Barcelona (ES); Maria Isabella Borrell Bayona, Manresa (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/126,441

(22) PCT Filed: Jun. 15, 2011

(86) PCT No.: PCT/US2011/040521

§ 371 (c)(1),
(2), (4) Date: Dec. 15, 2013

(87) PCT Pub. No.: WO2012/173617

PCT Pub. Date: Dec. 20, 2012

(65) Prior Publication Data

US 2014/0111568 A1 Apr. 24, 2014

(51) Int. Cl.

| | |
|---|---|
| ***B41J 29/38*** | (2006.01) |
| ***B41J 2/195*** | (2006.01) |
| ***B41J 2/165*** | (2006.01) |
| ***B41J 2/175*** | (2006.01) |
| ***B41J 2/185*** | (2006.01) |
| ***B41J 2/17*** | (2006.01) |

(52) U.S. Cl.
CPC ..... *B41J 2/175* (2013.01); *B41J 2/1721* (2013.01); *B41J 2/185* (2013.01)

(58) Field of Classification Search
CPC ..... B41J 2/16523; B41J 2/17509; B41J 2/17513; B41J 2/1721; B41J 2/175; B41J 2/17566; B41J 2002/1728; B41J 2/185; B41J 2002/1742; B41J 2/1742
USPC ..... 347/6, 7, 29, 36
See application file for complete search history.

(56) References Cited

U.S. PATENT DOCUMENTS

| | | | | |
|---|---|---|---|---|
| 5,745,134 | A | 4/1998 | Hirabayashi et al. | |
| 7,625,060 | B2 | 12/2009 | Kosugi et al. | |
| 7,664,432 | B2 | 2/2010 | Miller | |
| 7,665,819 | B2 | 2/2010 | Nicodem | |
| 7,712,862 | B1 * | 5/2010 | Campillo et al. | 347/19 |

(Continued)

FOREIGN PATENT DOCUMENTS

| | | |
|---|---|---|
| KR | 10-0193722 | 6/1999 |

OTHER PUBLICATIONS

Patent Cooperation Treaty, "International Search Report," issued in connection with Application No. PCT/US2011/040521, Feb. 10, 2012, 4 pages.

(Continued)

*Primary Examiner* — Jannelle M Lebron

(57) ABSTRACT

Methods and cassettes for discarding ink are disclosed. An example cassette includes a housing having a form factor to be received in a printer; a container to receive the discarded ink; and a memory to receive usage data from the printer, the usage data being indicative of an amount of the discarded ink received by the container.

20 Claims, 5 Drawing Sheets

(56) References Cited

U.S. PATENT DOCUMENTS

| | | | | |
|---|---|---|---|---|
| 2004/0021751 | A1 | 2/2004 | Steinmetz et al. | |
| 2009/0100946 | A1* | 4/2009 | Balinsky et al. | 347/6 |
| 2009/0219337 | A1* | 9/2009 | Harada et al. | 347/6 |
| 2009/0256884 | A1 | 10/2009 | Aoki | |
| 2010/0166441 | A1 | 7/2010 | Kobayashi | |
| 2010/0182365 | A1 | 7/2010 | Kayanaka | |

OTHER PUBLICATIONS

Patent Cooperation Treaty, "Written Opinion of the International Searching Authority," issued in connection with Application No. PCT/US2011/040521, Feb. 10, 2012, 4 pages.

Manjoo, "Take That, Stupid Printer!" Aug. 21, 2008, 3 pages.

* cited by examiner

METHODS AND CASSETTES FOR DISCARDING INK

BACKGROUND

Known printers perform operations that cause ink to be discarded into one or more waste containers. Waste containers to collect discarded ink are sometimes arranged in a cassette that can be removably installed in a printer.

DETAILED DESCRIPTION

Figure 1:
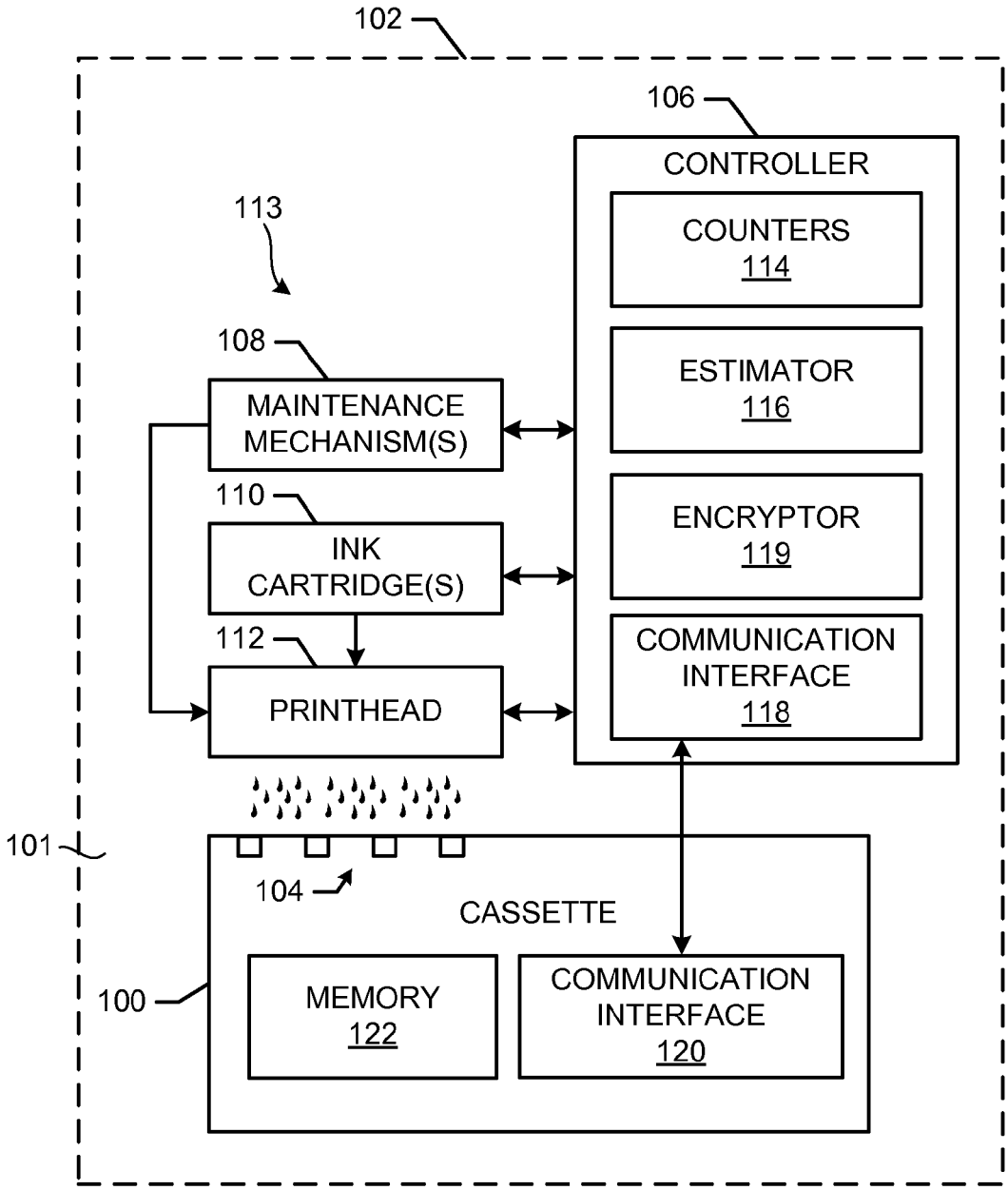
FIG. 1 illustrates an example cassette disclosed herein in communication with an image forming apparatus.

Image forming devices, such as printers, typically discard some image forming material, such as ink, as waste in connection with one or more procedures or operations. For example, a service station of a printer may perform a spitting procedure to remove or reduce clogs from a print head. Removing clogs from a print head sometimes includes forcing ink through a nozzle. The image forming device performing such a procedure discards the ink forced through the nozzle as waste.

In some examples, a wiper mechanism of a printer cleans excess ink or debris from the print head as part of a cleaning procedure. In such examples, the image forming device discards the excess ink as waste. The discarded ink resulting from these and/or other procedures is collected in waste containers. Waste containers are sometimes arranged on a cassette that can be removably installed in an image forming device. In such instances, the waste containers are typically configured such that components of the image forming device, such as nozzles associated with a print head, feed a corresponding waste container.

As the waste containers collect discarded ink, pillars of dried ink (also referred to as "ink stalagmites") can grow upwards towards a print head, a pen nozzle plate, and/or any other device that feeds the waste containers. Growth of the ink stalagmites to a point near the printer head, pen nozzle plate, etc. can interfere with print head movement, reduce print quality, lead to internal ink contamination, promote clogging of print head nozzles, cause hardware breakdown, and/or lead to additional or alternative problematic conditions. Even without formation of ink stalagmites, the waste containers have a capacity that, when exceeded, can cause problematic conditions in an image forming device.

To avoid potential problems or complications associated with ink stalagmites and/or the capacity of a waste container being exceeded, some image forming devices employ counters to track an amount of discarded ink collected by each waste container. Each counter counts the drops of ink expelled from, for example, a print head into a corresponding waste container. A controller of the image forming device executes an algorithm, using the number of drops as an input, to calculate or estimate the amount of ink stored in a waste container. In some examples, the algorithm takes potential stalagmite growth into account to estimate a height at which the discarded ink extends from a waste container. The image forming device stores the amount of discarded ink for each waste container, as well as the calculated or estimated ink amounts and/or growths, in a memory of the image forming device. The image forming device references the memory to determine whether one or more of the waste containers (or a device including the waste containers, such as a mono-cassette housing a plurality of waste containers) are full and, thus, should be replaced. In some instances, when at least one waste container is full or at least one ink stalagmite has grown to within a threshold distance of the print head, the image forming device ceases operation until the waste container(s) and/or the cassette in which the waste containers are located is replaced.

However, a waste container or a cassette including a plurality of waste containers is sometimes replaced before the image forming device determines that the waste containers are full or that a stalagmite has grown too high. Additionally, used waste containers already containing some discarded ink are often used as replacements instead of unused, empty waste containers. However, image forming devices expect to receive empty waste containers. In such instances, the image forming device operates on faulty information regarding the amount of discarded ink present in the waste container(s). Basing operation on faulty information related to the amount of discarded ink in a waste container can result in the image forming device failing to cease image forming operations before the discarded ink contaminates the components of the image forming device.

Example methods and apparatus disclosed herein enable image forming devices to operate based on accurate information related to discarded ink in one or more waste containers and, thus, to avoid adverse effects of discarded ink contaminating components of the image forming devices. In particular, data related to an amount of discarded ink in one or more waste containers is stored in a memory located on a device, such as a cassette, housing the waste container(s). The amount of discarded ink in a waste container may be referred to as a usage level of that particular waste container. The memory located on the device housing the waste container(s) and, therefore, the usage level data associated with the waste container(s) of the device, travels with the device. As a result, when the device is removed from a first image forming device and installed into a second image forming device, the second image forming device is aware of the usage level of the waste containers of the device and can base image forming operations on this accurate usage level data. In contrast, in previous systems, the second image forming device would base decisions to continue or cease image forming operations on inaccurate usage level data, such as usage level data tracked by the second image forming device in association with a waste container previously installed in the second image forming device. Alternatively, in previous systems, the second image forming device may base decisions to continue or cease image forming operations on inaccurate usage level data by assuming that an unused, empty waste container was being installed instead of the actual used waste container already having discarded ink collected therein. The example methods and apparatus disclosed herein avoid these errors by causing the usage level data to travel with the corresponding waste container(s) by storing such data in a memory located on a device carrying the waste container(s) (e.g., a cassette) and by enabling an image forming device to read the memory. In such disclosed examples, an image forming device obtains usage level data directly from the waste container(s) and decisions to continue or cease image forming operations is, thus, based on accurate data.

FIG. 1 illustrates an example apparatus 100 implemented in accordance with the teachings of the disclosure. The example apparatus 100 of FIG. 1 is shown as a cassette having a formation to facilitate removal and installation in a bay 101 of an image forming apparatus such as a printer. However, the example methods and apparatus disclosed herein may be implemented in connection with different housings having different form factors (e.g., a standalone waste container). The example cassette 100 of FIG. 1 may be used in combination with and/or installed in an image forming device 102 to collect discarded ink from the image forming device 102. The example image forming device 102 of FIG. 1 is shown as a printer. However, the example cassette 100 of FIG. 1 may be used in combination or installed in alternative types of image forming devices. The example cassette of FIG. 1 includes a housing in which a plurality of waste containers 104 is located.

The example printer 102 of FIG. 1 includes a controller 106 to, among other things, operate components of the printer 102. In the illustrated example, the printer 102 includes maintenance mechanism(s) 108, ink cartridge(s) 110, and a print head 112 that are part of a print assembly 113. The print assembly 113 may include additional or alternative components for forming an image. The controller 106 of the illustrated example communicates with the ink cartridge(s) 110 and/or the print head 112 to form an image on a substrate, such as paper. The ink cartridge(s) 110 supply ink to the print head 112, which the controller 106 operates to print a desired pattern of ink on the substrate. The example maintenance mechanism(s) 108 implement one or more maintenance procedures for components of the printer 102. In the illustrated example, the maintenance mechanism(s) 108 implement a spitting procedure that reduces or removes clogs from one or more nozzles of the print head 112. The spitting procedure forces ink through the nozzles at or above a threshold pressure such that ink clogs formed due to, for example, dried ink, are at least partially expelled from the nozzles. The example maintenance mechanism(s) 108 of FIG. 1 also implement a wiper procedure that cleans one or more surfaces of the print head 112. The wiper procedure employs a wiper to contact the surface(s) to be cleaned to remove any extra ink resting at an undesirable position. Additional or alternative maintenance devices and/or procedures may be implemented by the example maintenance mechanism(s) 108 of FIG. 1. Further, the example printer 102 may include additional or alternative components, such as, for example, a curing assembly, to facilitate formation of an image on a substrate.

The controller 106 includes counters 114. Each of the counters 114 counts a number of ink droplets discarded by a corresponding component of the printer 102. For example, a first one of the counters 114 counts a number of ink droplets discarded by a first nozzle of the print head 112. A second one of the counters 114 counts a number of ink droplets discarded by a second nozzle of the print head 112. A third one of the counters 114 counts a number of ink droplets discarded by a wiper that cleans surfaces of the print head 112. Discarding of ink may result from, for example, the spitting procedure and/or the wiper procedure implemented by the example maintenance mechanism(s) 108 of FIG. 1. Generally, the printer 102 may discard ink due to additional or alternative procedures, circumstances, devices, etc.

The example controller 106 of the printer 102 also includes an estimator 116 to estimate growth of ink stalagmites. In the illustrated example, the estimator 116 uses data from the counters 114 to determine a likely amount of stalagmite growth for each of the waste containers tracked by the counters 114. Thus, the estimations generated by the estimators 116 are functions of the amount of ink discarded by, for example, the print head 112. In the illustrated example, results generated by the estimator 116 and the data associated with the counters 114, which is sometimes referred to herein collectively as usage level data, is stored in a memory of the printer 112 accessible by the controller 106. As described above, printers storing usage level data on a memory of the printer only are exposed to increased risk of ink contamination resulting from basing printing operations on inaccurate information.

The example controller 106 of FIG. 1 also includes an encryptor 119 to encrypt data tracked by the counters 114 and/or generated by the estimator 116. The encryptor 116 may append to and/or modify data tracked by the counters 114 and/or generated by the estimator 116 to prevent tampering with the usage level data.

In the illustrated example of FIG. 1, usage level data tracked by the example counters 114 and generated by the estimator 116 is communicated to the cassette 100 via a communication interface 118. As described above, the usage level data may also be encrypted by the encryptor 119 before being conveyed to the cassette 100 to prevent unauthorized modification of the usage level data after being received at the cassette 100. In the illustrated example of FIG. 1, the cassette also includes a communication interface 120 to exchange information, such as usage level data, between the cassette 100 and the controller 106 of the printer 102. The communication interface 118 of the printer 102 and the communication interface 120 of the cassette 100 can be implemented by any suitable wired or wireless protocol.

The usage level data collected and/or generated by the controller 106 and conveyed to the cassette 100 via the communication interfaces 118 and 120 is stored in a memory 122 in the example cassette 100 of FIG. 1. As described above, the usage level data reflects amounts of ink discarded by the printer 102 into respective ones of the waste containers 104 of the cassette 100. In the illustrated example, the memory 122 is implemented by an Acumen 2.5 memory card affixed to a surface of the cassette 100. However, the example cassette 100 disclosed herein can utilized any suitable type of memory to store usage level data. The example memory 122 includes an Electrically-Erasable Programmable Read Only Memory (EEPROM) to store the usage level data related to the contents of the waste containers 104. As described below in connection with FIG. 2, the example memory 122 illustrated in FIG. 1 also stores a digital signature to enable a user of the cassette 100 to verify authenticity and/or compatibility of the cassette 100 with the printer 102.

After the cassette 100 is removed from the printer 102, a user may swap the cassette 100 into a second printer. Unlike previous cassettes, the example cassette 100 of FIG. 1 stores usage level data, which is indicative of amounts of discarded ink already present within the waste containers 104. Because the usage data is stored in the memory 122 that is affixed to the cassette 100, the usage data is removed from the printer 102 and installed into the second printer when the cassette 100 is removed and installed. The memory 122 of the example cassette 100 is, thus, readable by the second printer receiving the cassette 100 in the event of the swapping described above. Accordingly, the second printer can base printing operations on accurate usage level data, thereby avoiding errors such as inadvertent contamination from overflowing waste containers. Further, in the event that the cassette 100 is returned to the first example printer 102 of FIG. 1, the controller 106 can read the example memory 122 of the cassette after the cassette 100 is re-installed in the first printer 102 and can then update the counters 114 within the controller 106 using the usage level data stored in the memory 122 of the cassette 100. Thus, a printer receiving the example cassette 100 of FIG. 1 bases decision(s) to continue or cease printing operations on accurate data related to the waste containers 104.

Figure 2:
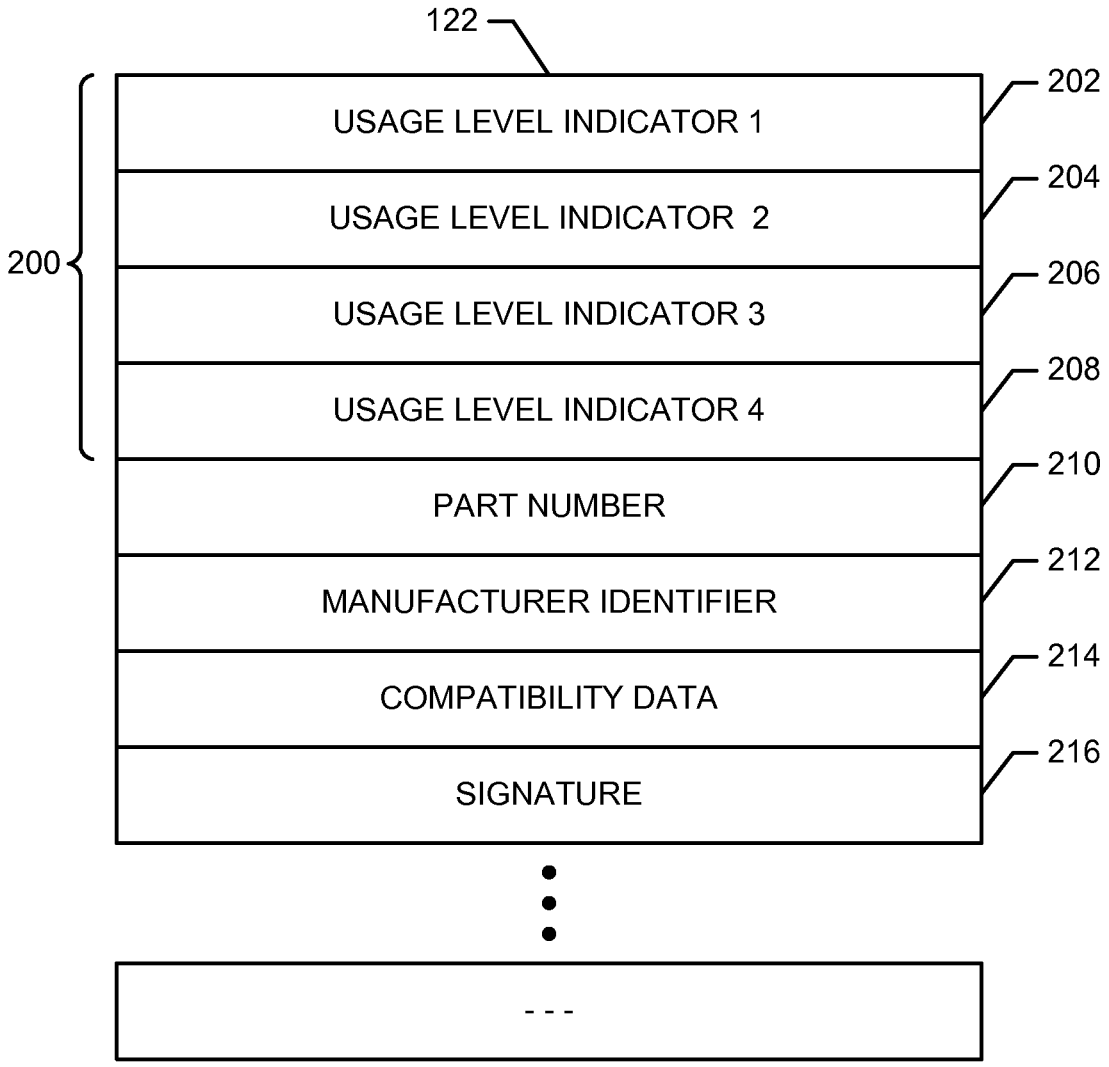
FIG. 2 illustrates example entries of the memory of FIG. 1.

FIG. 2 is a listing of example entries which may be stored in the memory 122 of the example cassette 100 of FIG. 1. Although the example memory entries of FIG. 2 are listed in an order, the example memory 122 can be configured, addressed or otherwise implemented in any suitable manner. The example memory 122 of FIG. 2 includes a plurality of usage level indicators 200, each of which includes data related to an individual one of the waste containers 104 of FIG. 1. Thus, a first usage level indicator 202 includes data related to an amount of discarded ink in a first one of the waste containers 104, a second usage level indicator 204 includes data related to an amount of discarded ink in a second one of the waste containers 104, and a third usage level indicator 206 includes data related to an amount of discarded ink in a third one of the waste containers 104. In the example of FIG. 2, a fourth usage level indicator 208 includes data related to an amount of discarded ink in another waste container not shown in FIG. 1, such as a waste container that collects discarded ink from a source other than the print head 112 of FIG. 1. The data stored as the usage level indicators 200 can include information generated by the counters 114, information generated by the estimator 116, and/or some combination of information generated by the counters 114 and information generated by the estimator 116. Additionally, the data stored in the usage level indicators 200 can include administrative or processing data, such as identifiers associated with the corresponding waste containers, timestamps, etc.

The example memory 122 of FIG. 2 also includes a part number 210 of the example cassette 100 of FIG. 1. The part number may have been assigned to the cassette 100 by, for example, a manufacturer or designer of the cassette 100. The example memory 122 of FIG. 2 also includes a manufacturer identifier 212 that designates an entity that designed, sold, and/or created the cassette 100. The example memory 122 of FIG. 2 also includes compatibility data 214 indicative of one or more printers with which the cassette 100 is compatible. The compatibility data 214 may be, for example, a code corresponding to part numbers of compatible printers. The example memory 122 of FIG. 2 also stores a digital signature 216 that can be used to verify that the cassette 100 and the information stored in the memory 122 of the cassette 100 is authentic. In the illustrated example, the digital signature 216 is a key that is protected from alteration. However, the example cassette 100 and/or the example memory 122 can utilize any suitable type of signature. The example digital signature 216 of FIG. 2 prevents the printer 102 from receiving and/or operating with a counterfeit cassette not manufactured by a trusted or designated source. Using counterfeit cassettes can lead to, for example, deterioration of the print head 112 that adversely affects image quality and/or to the ink contamination described herein. The example digital signature 216 storing in the example memory 122 travels with the cassette 100 and thereby avoids potential problems that may arise from use of counterfeit cassettes.

Figure 3:
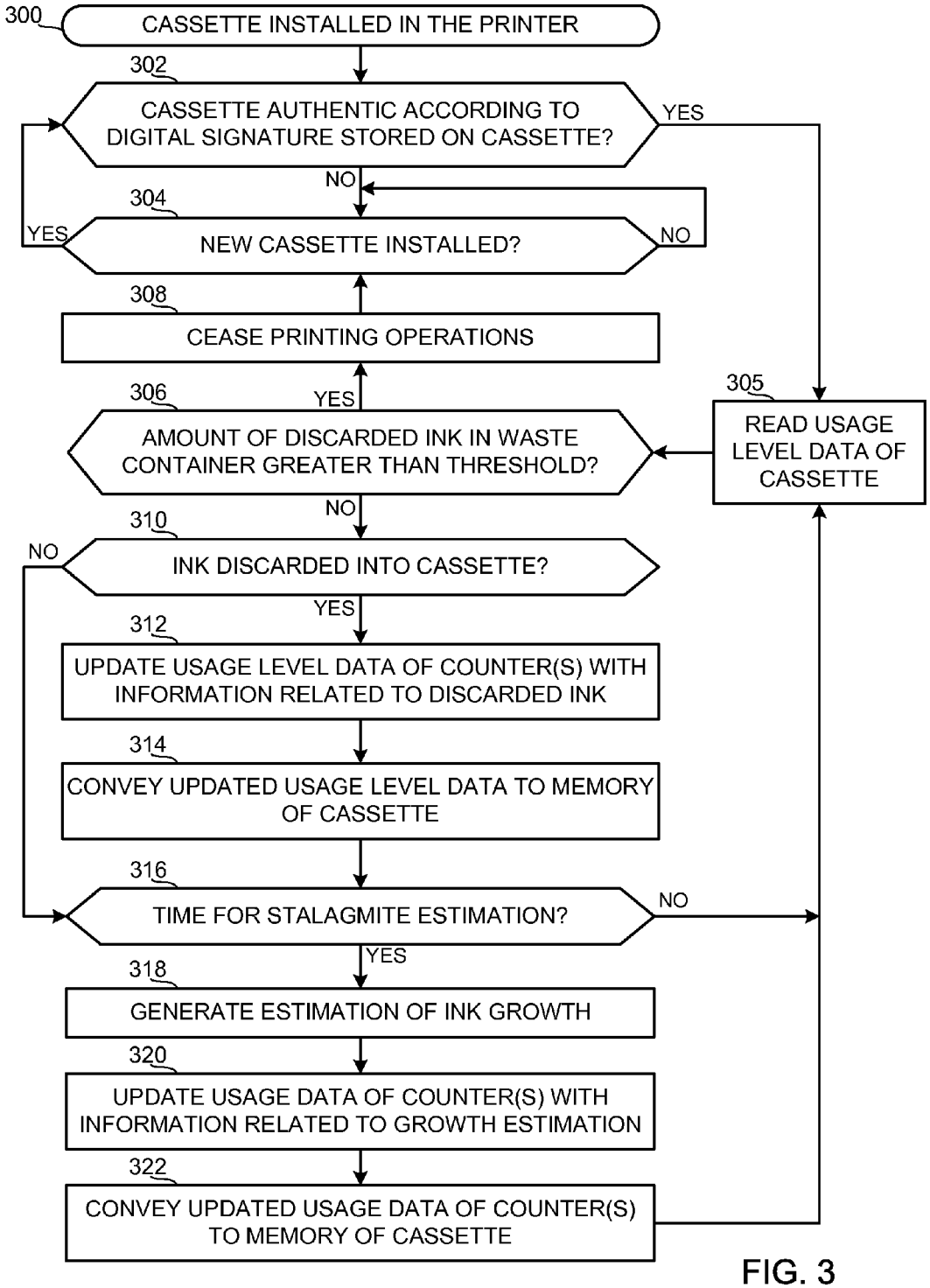
FIG. 3 is a flowchart illustrating example machine readable instructions that may be executed to implement the example controller of FIG. 1.

FIG. 3 is a flowchart representative of example machine readable instructions for implementing the controller 106 of FIG. 1. In this example, the machine readable instructions comprise a program for execution by a processor such as the processor 502 shown in the example processor platform discussed below in connection with FIG. 5. The program may be embodied in software stored on a computer readable medium such as a CD-ROM, a floppy disk, a hard drive, a digital versatile disk (DVD), or a memory associated with the processor 502, but the entire program and/or parts thereof could alternatively be executed by a device other than the processor 502 and/or embodied in firmware or dedicated hardware. Further, although the example program is described with reference to the flowchart illustrated in FIG. 3, many other methods of implementing the example cassette 100 may alternatively be used. For example, the order of execution of the blocks may be changed, and/or some of the blocks described may be changed, eliminated, or combined.

The example process of FIG. 3 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals. Additionally or alternatively, the example process of FIG. 3 may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals. For purposes of illustration and not by way of limitation, the example instructions of FIG. 3 will be discussed with reference to the example cassette 100 and the example controller 106 of FIG. 1.

The example instructions of FIG. 3 begin with an installation of the cassette 100 in any image forming device, which, for purposes of discussion will be referred to as the printer 102 of FIG. 1 (block 300). When the cassette 100 is installed in an image forming device (block 302), the example controller 106 of the printer 102 begins communicated with the memory 122 of the cassette 100 (e.g., via the communication interface 120 of the cassette 100). In the illustrated example, the controller 106 determines whether the cassette 100 is authentic (e.g., manufactured by a trusted and/or contracted entity) by accessing the digital signature 216 of the memory 122 (block 302). In some examples, the controller 106 may, additionally or alternatively, access the compatibility data 214 of the memory 122 of the cassette 100 to determine whether the cassette 100 is compatible with the printer 102. When the digital signature of the memory 122 indicates that the cassette 100 is not authentic (block 302), the controller 106 waits for a new cassette to be installed in the printer (block 304). In some examples, the controller 106 also communicates a message (e.g., via a display or speaker) to a user of the printer 102 that the cassette 100 is not authentic or that the cassette 100 incompatible with the printer 102. When a new cassette is installed, the controller 106 attempts to verify the authenticity of the new cassette by reading the digital signature of the new cassette (block 302).

When an authentic cassette 100 is installed in the printer 102 (block 302), the controller 106 reads usage level data 200 from the memory 122 of the cassette 100 (block 305). When the usage level data indicates that at least one of the waste containers 104 has an amount of discarded ink that exceeds a threshold (block 306), the controller 106 causes the printer 102 to cease printing operations (block 308). As described above, such a reading from the memory 122 indicates that further printer operations may lead to ink contamination or hardware breakdown. When printing operations are ceased at block 308, control returns to block 304 and the controller 106 waits for installation of a new authentic cassette. Otherwise, when the usage level data of the cassette read at block 305 indicates that the amount of discarded ink the waste containers 104 is equal to or below the threshold (block 306), the controller 106 continues printing operations.

When ink has been discarded into the waste containers 104 of the cassette 100 (block 310), the controller 106 updates the counters 114 with information related to an amount of ink discarded into the waste containers 104 (block 312). The controller 106 then conveys the updated usage level data to the memory 122 of the cassette 100 via the communication interface 118 (block 314). The controller 106 then references the estimator 119 to determine whether the estimator 119 is scheduled to perform an estimation of ink stalagmite growth in one or more of the waste container 104 (block 316). If so, the estimator 119 generates an estimation of ink growth in the scheduled waste container(s) 104 (block 318). The estimation is used to update usage level data tracked by the printer 102 (block 320). Additionally, the communication interface 118 conveys information related to the estimation generated by the estimator 119 to the cassette 100 such that the updated usage level data can be stored in the memory 122 to reflect the current levels of discarded ink in the waste container 104 (block 322). Control then returns to block 305.

Figure 4:
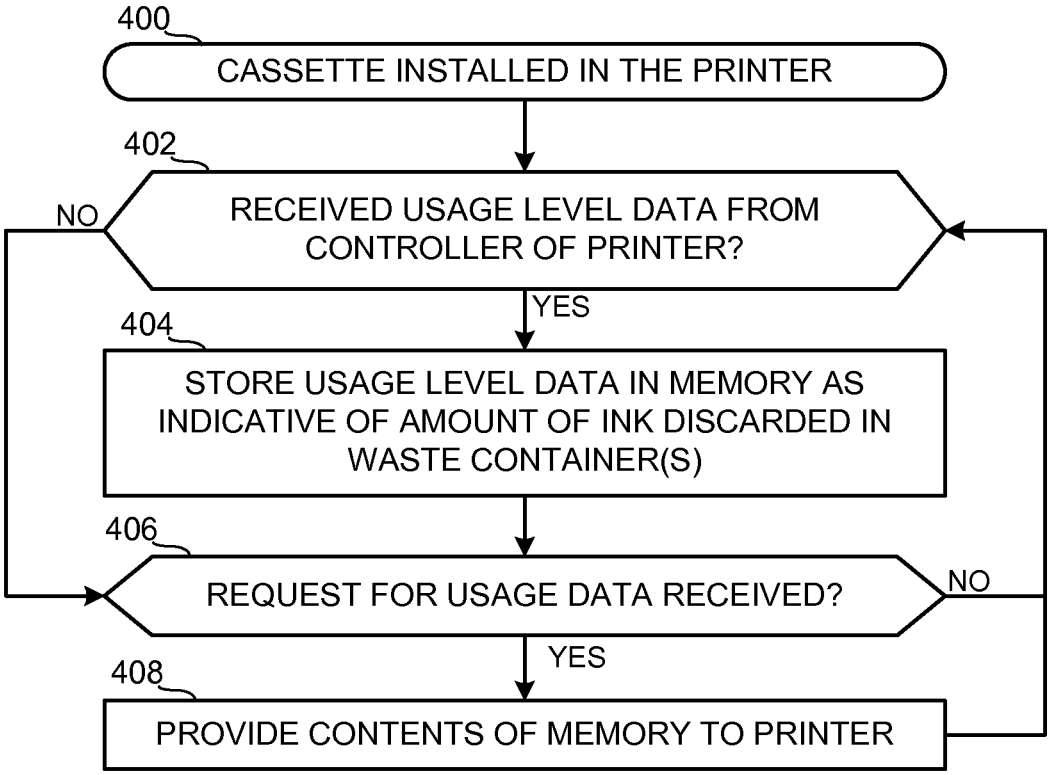
FIG. 4 is a flowchart illustrating an example process that may be performed by the example cassette of FIG. 1.

FIG. 4 illustrates an example process that can be executed by the example cassette 100 of FIG. 1. The example process of FIG. 3 begins with an installation of the cassette 100 in the example printer 102 of FIG. 1 (block 400). When usage level data is received at the communication interface 120 of the cassette 100 (block 402), the memory 122 stores the usage level data in one or more of the usage level indicators 200 of FIG. 2 (block 404). Further, when a request for usage level data is received from the controller 106 of the printer (block 406), the memory 122 provides access to its contents to the controller 106 (block 408). Control then returns to block 402.

Figure 5:
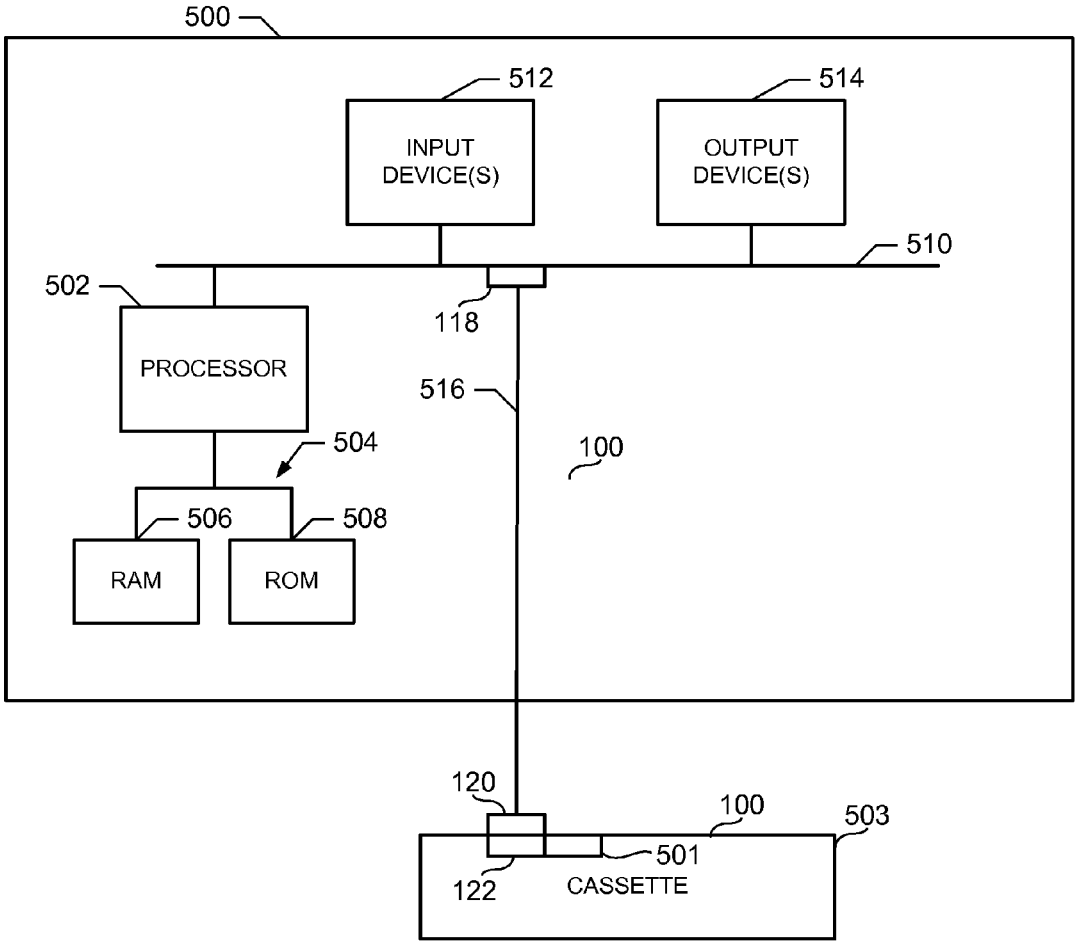
FIG. 5 illustrates an example implementation of the example cassette of FIG. 1.

FIG. 5 is a block diagram of an example implementation of the example controller 106 of FIG. 1. The example controller 106 of FIG. 5 includes a processor platform 500 which executes the instructions of FIG. 3. The example instructions of FIG. 4 are executed by the example memory controller 501 of FIG. 5. The platform 500 can be, any type of processing platform to execute instructions. The platform 500 of the instant example includes a processor 502. For example, the processor 502 can be implemented by one or more microprocessors, embedded microcontrollers, system on a chip (SoC), and/or any other type of logic circuit, processing circuit, arithmetic circuit, and/or logical unit.

The processor 502 of the illustrated example is in communication with a main memory 504 including a volatile memory 506 and a non-volatile memory 508. The volatile memory 506 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 508 may be implemented by read-only memory (ROM), flash memory, and/or any other desired type of memory device. Access to the main memory 504 is controlled by a memory controller. The coded instructions of FIG. 3 may be stored in the machine readable main memory 504.

The platform 500 also includes an interface circuit, such as a bus 510. The bus 510 may be implemented by any type of interface standard, such as an Ethernet interface, a universal serial bus (USB), and/or a PCI express interface. Input device(s) 512 are connected to the bus 510. The input device(s) 512 permit a user to enter data and commands into the processor 502. The input device(s) 512 can be implemented by, for example, a keyboard, a programmable keypad, a mouse, a touchscreen, a track-pad, a trackball, isopoint, and/or a voice recognition system. Output device(s) 514 are also connected to the bus 510. The example output device(s) 514 of FIG. 5 are implemented, for example, by display devices (e.g., a liquid crystal display, a cathode ray tube display (CRT), and/or speakers).

The processor 502 of the illustrated example provides data to and reads data from the example memory 122 of the cassette 100 in cooperation with the memory controller 501. In some examples, the memory controller 501 is omitted and the memory 122 has the ability to be controlled by, for example, the processor 502. In the illustrated example, a connector 516 (e.g., an I2C cable, a USB cable, etc.) couples the communication interface 118 of the controller 106 to the communication interface 120 of the cassette 100. The processor 502 of the illustrated example of FIG. 5 communicates with the memory 122 of FIG. 1 (e.g., in cooperation with the memory controller 501 of the cassette 100) to facilitate exchanges of data, such as usage level data, between the cassette 100 and the controller 106 of the printer 102. In the illustrated example, the memory 122 is a capture card affixed to an outer surface of the cassette 100. However, the memory 122 can alternatively be integral to a housing 503 of the cassette 100, which may include a form factor configured for installation in one or more image forming devices.

The above-disclosed example methods and/or apparatus may be make decision(s) whether to continue, start or cease printing operations based on accurate information related to discarded ink collected in a waste container which is removable from a printer or other image forming device. In contrast to known systems, example methods and apparatus disclosed herein store usage level data on a memory of a removable device including waste containers configured to collect discarded ink and intended to be removed from the image forming device and replaced from time to time as part of the ordinary usage of the image forming device. The memory of the removable/replaceable device is readable by printers in which the device is installed. Because the memory travels with the removable device, the usage level data on which the printer bases operation is accurate even if the removable device is installed with already full waste container(s). As a result, hardware breakdown, ink contamination, and/or other problem(s) caused by using inaccurate information related to discarded ink are reduced and/or avoided Although certain example apparatus, methods, and articles of manufacture have been disclosed herein, the scope of coverage of this patent is not limited thereto. On the contrary, this patent covers all apparatus, methods, and articles of manufacture fairly falling within the scope of the claims of this patent.

What is claimed is:

1. A cassette for discarding ink, comprising:

a housing having a form factor to be received in a printer;

a container to receive the discarded ink; and a memory comprising usage data received from the printer, the usage data being indicative of an amount of the discarded ink received by the container and an estimate of ink stalagmite growth within the container, the estimate determined based on the amount of the discarded ink received.

2. A cassette as defined in claim 1, wherein the memory is to store a digital signature associated with the cassette.

3. A cassette as defined in claim 2, wherein the digital signature is to be readable by the printer to verify authenticity of the cassette.

4. A cassette as defined in claim 1, wherein the memory is to store compatibility data associated with the cassette indicative of a type of printer with which the cassette is compatible.

5. A cassette as defined in claim 1, wherein the memory and the container are carried by the housing and further comprising a communication interface to enable the usage data of the memory to be readable by the printer.

6. A cassette as defined in claim 1, wherein the usage data is to be updated based on a counter implemented by the printer to count a number of drops of ink discarded into the container.

7. A cassette as defined in claim 1, wherein the memory comprises a capture card affixed to an outer surface of the housing.

8. A method, comprising:

receiving usage data at a cassette carrying a container, the usage data being indicative of an amount of discarded ink received by the container and an estimate of ink stalagmite growth within the container, the estimate determined based the amount of the discarded ink received; and storing the usage data in a memory coupled to the cassette.

9. A method as defined in claim 8, further comprising providing access to the usage data to a printer.

10. A method as defined in claim 9, wherein the memory comprises a capture card affixed to an outer surface of the cassette.

11. A method as defined in claim 8, further comprising storing a digital signature associated with the cassette in the memory.

12. A method as defined in claim 11, wherein the digital signature is readable by a printer to verify authenticity of the cassette.

13. A method as defined in claim 8, further comprising storing compatibility data associated with the cassette in the memory, the compatibility data being indicative of a type of printer with which the cassette is compatible.

14. A method as defined in claim 8, wherein the usage data is generated by a counter of the printer, the counter to count a number of drops of ink discarded into the container.

15. A printer comprising:

a print assembly to form an image;

a counter to track an amount of ink discarded by the print assembly;

a cassette to receive the discarded ink; and an estimator to estimate an amount of ink stalagmite growth based on a value received from the counter indicative of the amount of ink discarded, the cassette including a memory to store data generated by the counter and the estimator as a usage indicator.

16. A printer as defined in claim 15, further comprising a communication interface to enable exchange of information between the memory of the cassette and a controller of the printer.

17. A printer as defined in claim 15, further comprising a controller to determine whether to continue or cease a print operation based on the usage indicator of the memory of the cassette.

18. A printer as defined in claim 17, wherein the controller is to cease the print operation and wait for installation of a second cassette in response to the usage indicator indicating that an amount of discarded ink exceeds a threshold.

19. A printer as defined in claim 18, wherein the controller is to read a second usage indicator of the second cassette in response to the second cassette being installed in the printer, and the controller is to determine whether to continue or cease the print operation based on the second usage indicator of the second cassette.

20. A printer as defined in claim 19, wherein the second usage indicator of the second cassette is stored in a second memory affixed to the second cassette.

* * * * *